US006773327B1

(12) United States Patent
Felice et al.

(10) Patent No.: US 6,773,327 B1
(45) Date of Patent: Aug. 10, 2004

(54) APPARATUS FOR ACTUATING A TOY

(75) Inventors: Robert P. Felice, Woonsocket, RI (US); Richard Maddocks, Barrington, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/073,122

(22) Filed: Feb. 12, 2002

(51) Int. Cl.[7] ..... A63H 11/00; A63H 13/00; A63H 3/20

(52) U.S. Cl. ..... 446/330; 446/354; 446/390; 623/58

(58) Field of Search ..... 446/330, 331, 446/352, 353, 354, 355, 356, 490, 486, 390, 368; 623/58, 63

(56) References Cited

U.S. PATENT DOCUMENTS

| | | | | | |
|---|---|---|---|---|---|
| 2,194,537 | A | * | 3/1940 | Adams | 446/353 |
| 2,421,279 | A | * | 5/1947 | Marty | 446/331 |
| 2,614,365 | A | | 10/1952 | Musselwhite et al. | |
| 3,266,059 | A | * | 8/1966 | Stelle | 623/62 |
| 4,494,417 | A | * | 1/1985 | Larson et al. | 446/368 |
| 4,516,951 | A | | 5/1985 | Saigo et al. | |
| 4,571,208 | A | * | 2/1986 | Saigo et al. | 446/353 |
| 4,601,671 | A | | 7/1986 | DeMars | |
| 4,802,878 | A | * | 2/1989 | Terzian et al. | 446/352 |
| 4,815,911 | A | * | 3/1989 | Bengtsson et al. | 446/368 |
| 4,968,280 | A | | 11/1990 | Kelley | |
| 5,080,681 | A | * | 1/1992 | Erb | 623/63 |
| 5,080,682 | A | * | 1/1992 | Schectman | 623/64 |
| 5,297,443 | A | * | 3/1994 | Wentz | 446/390 |
| 5,324,225 | A | | 6/1994 | Satoh et al. | |
| 5,378,188 | A | | 1/1995 | Clark | |
| 5,409,447 | A | * | 4/1995 | Wedge, Jr. | 601/40 |
| 5,931,715 | A | | 8/1999 | Chang | |
| 6,200,190 | B1 | | 3/2001 | Reynolds | |
| 6,371,826 | B1 | | 4/2002 | Pestonji | |
| 6,458,010 | B1 | * | 10/2002 | Yamagishi et al. | 446/330 |

FOREIGN PATENT DOCUMENTS

| | | | | |
|---|---|---|---|---|
| DE | 19755465 A1 | * | 6/1999 | A61F/2/54 |
| GB | 2221401 A | * | 2/1990 | A63H/13/00 |
| GB | 2222959 A | * | 3/1990 | A63H/13/00 |
| JP | 11207042 A | * | 8/1999 | A63H/9/00 |
| JP | 2001300149 A | * | 10/2001 | A63H/11/00 |

* cited by examiner

*Primary Examiner*—Derris H. Banks
*Assistant Examiner*—Urszula M Cegielnik
(74) *Attorney, Agent, or Firm*—Fish & Richardson P.C.

(57) ABSTRACT

An apparatus for a moving a toy appendage includes a moveable device within a toy appendage that is attached to a body of a toy and an actuator connected to the moveable device. The actuator is configured to rotate the moveable device about a drive axis that is fixed relative to the body of the toy. The actuator is configured to rotate at least a first portion of the moveable device relative to at least a second portion of the moveable device about a device axis that is fixed relative to the moveable device.

23 Claims, 7 Drawing Sheets

APPARATUS FOR ACTUATING A TOY

TECHNICAL FIELD

This application relates to actuation of a toy.

BACKGROUND

Toys that have moving parts are well known. For example, dolls and plush toys such as stuffed animals are made with moveable appendages.

SUMMARY

In one general aspect, an apparatus for a moving a toy appendage includes a moveable device within a toy appendage that is attached to a body of a toy and an actuator connected to the moveable device. The actuator is configured to rotate the moveable device about a drive axis that is fixed relative to the body of the toy. The actuator is configured to rotate at least a first portion of the moveable device relative to at least a second portion of the moveable device about a device axis that is fixed relative to the moveable device.

Implementations may include one or more of the following features. For example, the actuator may include a motor, and a drive shaft connected to the motor and to the moveable device. The drive shaft defines the drive axis. The actuator may rotate the moveable device by causing the drive shaft to rotate the moveable device. The actuator may include a lever coupled to the at least first portion of the moveable device. The actuator may rotate the at least first portion of the moveable device relative to the second portion by causing the drive shaft to rotate the lever coupled to the moveable device.

The moveable device may include a flexible strip, a plate positioned in the at least first portion of the moveable device, with the plate being transversely connected to the flexible strip, and an elongated device that intersects the plate. The lever may be connected to the elongated device such that when the drive shaft rotates the lever, the lever actuates the elongated device to exert a tension on the plate, thus rotating the at least first portion of the moveable device relative to the second portion.

The motor may be configured to rotate the at least first portion relative to the at least second portion in a first device direction about the device axis if the drive shaft is rotated in a first main direction about the drive axis. Additionally, the motor may be configured to rotate the at least first portion relative to the at least second portion in a second device direction about the device axis if the drive shaft is rotated in a second main direction about the drive axis.

The at least first portion and the at least second portion may be included in the moveable device.

The main axis may be different from the device axis.

The actuator may be configured to rotate the at least first portion relative to the at least second portion in a first device direction about the device axis if the moveable device is rotated in a first main direction about the drive axis. The actuator may be configured to rotate the at least first portion relative to the at least second portion in a second device direction about the device axis if the moveable device is rotated in a second main direction about the drive axis.

Because of the motion imparted to the moveable device and the toy appendage, the apparatus provides a realistic actuation of a toy appendage.

Other features and advantages will be apparent from the description, the drawings, and the claims.

DESCRIPTION OF DRAWINGS

Like reference symbols in the various drawings indicate like elements.

DETAILED DESCRIPTION

Figure 1:
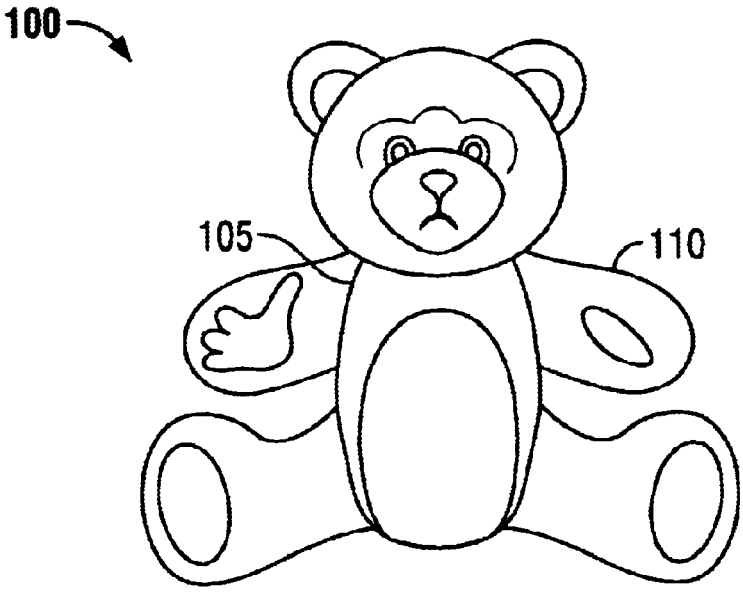
FIG. 1 is a perspective view of a toy.
Figure 2:
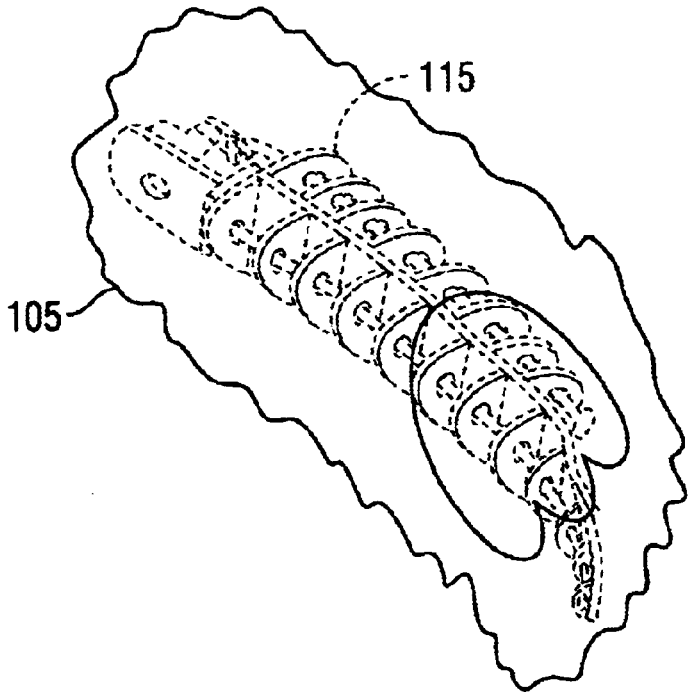
FIG. 2 is a perspective view of an appendage attached to the toy of FIG. 1.
Figure 3:
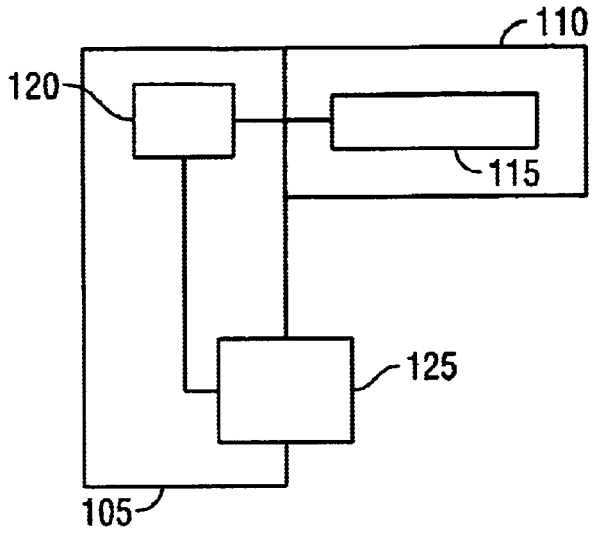
FIG. 3 is a block diagram of the toy of FIG. 1.

Referring to FIGS. 1–3, a toy 100 has a body 105 and an appendage 110 connected to the body 105. The toy 100 may be of any design, such as, for example, a doll, a plush toy such as a stuffed animal, or a robot. The body 105 of the toy 100 may be made of any suitable material. For example, if the toy is a stuffed animal, the body 105 may include a rigid internal shell surrounded by a resilient material and covered with a pile that resembles the animal's coat.

The appendage 110 includes a moveable device 115 that is actuated by an actuator 120 inside the body 105 to move the appendage 110. The actuator 120 is powered by a power source 125 that may or may not be internal to the body 105. In one implementation, the power source 125 may be an electric source that includes a battery. In this implementation, the battery is placed in the body 105 and may be turned off and on by a switch accessible on the body 105.

Figure 4:
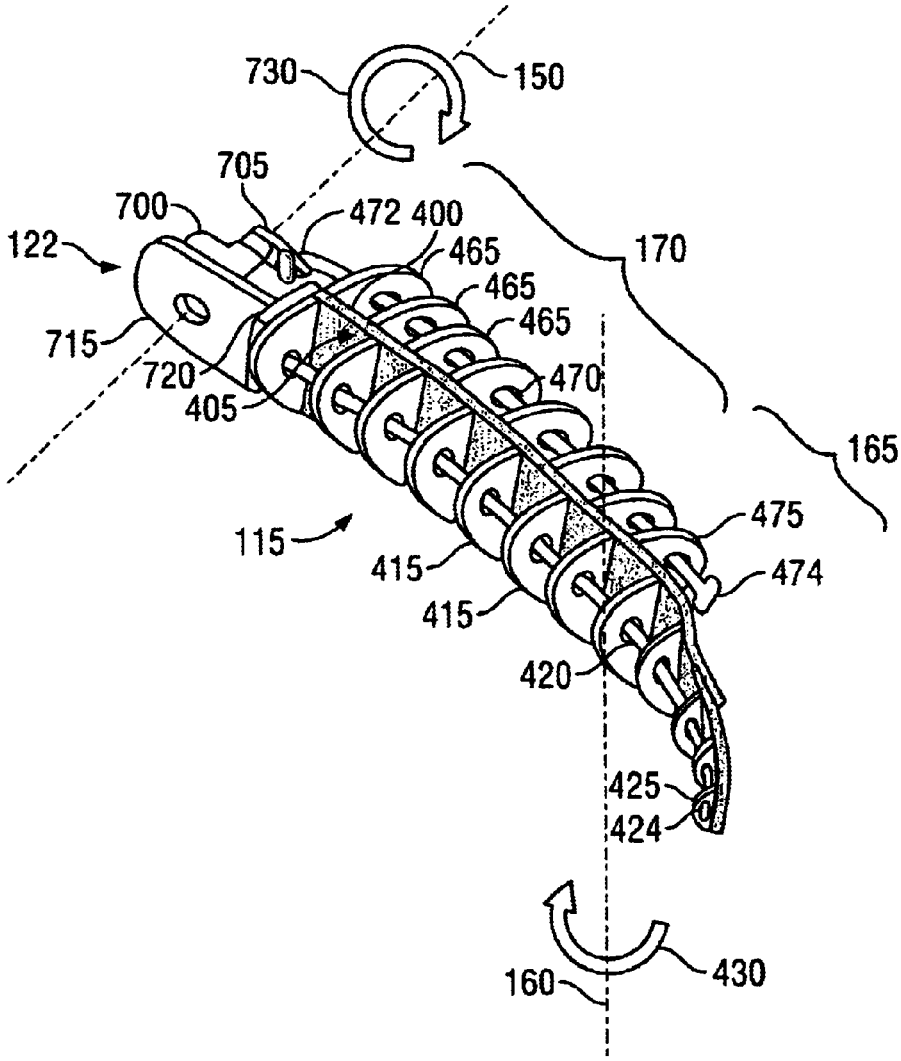
FIGS. 4, 5, and 10 are perspective views of a moveable device formed in the toy appendage of FIG. 2.
Figure 5:
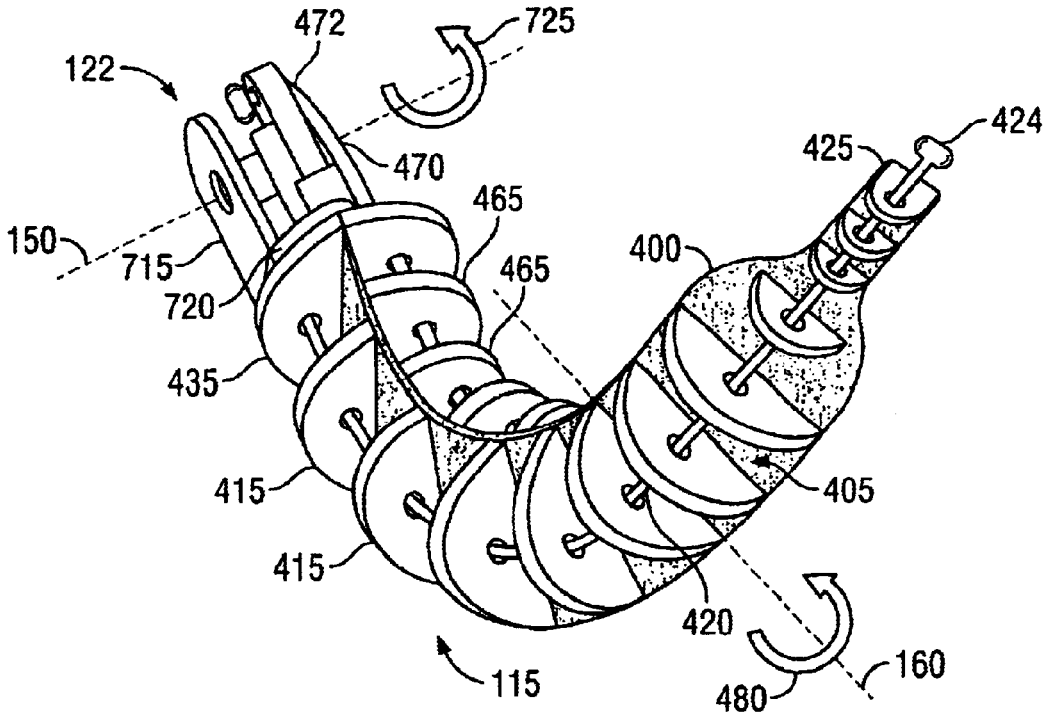
Figure 6:
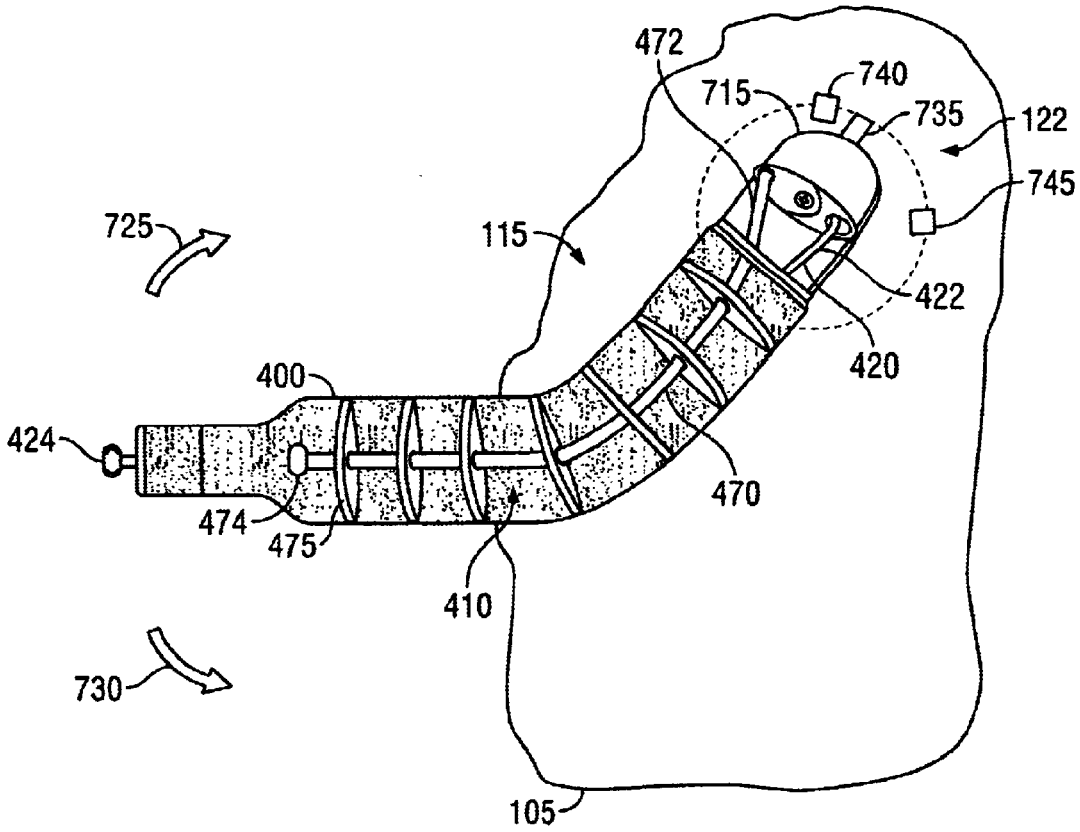
FIG. 6 is a side view of the moveable device formed in the toy appendage of FIG. 2.

Referring to FIGS. 4–6, in general, the actuator 120 is configured to rotate the moveable device 115 about a drive axis 150 that is fixed relative to the body 105 of the toy 100. Additionally, the actuator 120 is configured to rotate at least a first portion of the moveable device 115 relative to at least a second portion of the moveable device 115 about a device axis 160 that is fixed relative to the moveable device 115. The first portion of the moveable device 115 may be any portion of the moveable device 115, such as, for example, portion 165 (shown in FIG. 4). The second portion of the moveable device 115 may be any portion of the moveable device 115 that includes a portion not included in the first portion, such as, for example, portion 170 (shown in FIG. 5).

In particular, the moveable device 115 includes a flexible strip 400 that has a first surface 405 and a second surface 410. The flexible strip 400 may be made of any suitable material that is flexible. For example, the strip 400 may be made of a plastic that is either pliable or formed thin enough to bend. Additionally, the moveable device 115 includes at least one plate 415, at least one of which is transversely connected to the first surface 405. A plate 415 may be formed integrally to the flexible strip 400 during a molding process. Alternatively, a plate 415 may be formed separately from the formation of the flexible strip 400 and then attached to the flexible strip 400 using a suitable attachment technique. For example, a plate 415 may be glued to the flexible strip 400. As another example, a plate 415 may be shaped to fit into a slot formed in the flexible strip 400 and then snap fit into the slot during assembly. At least one of the plates 415 may be detached from the first surface 405, yet positioned near the first surface 405.

The moveable device 115 also includes a first elongated device 420 that intersects at least one of the plates 415. The first elongated device 420 may be made of any flexible material. In one implementation, the first elongated device 420 is made of a string that may become slack in the absence of any pulling force. In another implementation, the first elongated device 420 is made of a flexible, yet firm material such as a wire strip that may be pulled or pushed to provide tension to the device 420.

The first elongated device 420 has a first end 422 (shown in FIG. 6) that is connected to the actuator 120 (portions 122 external to the body 105 are shown in FIGS. 4–6) and a second end 424 that is designed to engage a plate 425 positioned along the first portion 165 of the moveable device 115, which is at the edge of the flexible strip 400 farthest from the body 105. In this way, when the first elongated device 420 is actuated by the actuator 120, the first elongated device 420 may be pulled toward the actuator 120 and the second end 424 engages the plate 425. Upon engagement of the plate 425, the flexible strip 400 bends and thus the first portion 165 is rotated in a first device direction (for example, in a direction as depicted by arrow 430 in FIG. 4) about the device axis 160.

The moveable device 115 may include at least one plate 465, at least one of which is transversely connected to the second surface 410. Like plate 415, the plate 465 may be formed integrally to the flexible strip 400 during a molding process. Alternatively, the plate 465 may be formed separately from the formation of the flexible strip 400 and then attached to the flexible strip 400 using a suitable attachment technique. For example, the plate 465 may be glued to the flexible strip 400 or shaped to snap fit into a slot formed in the flexible strip 400. At least one of the plates 465 may be detached from the second surface 410, yet positioned near the second surface 410.

The moveable device 115 also may include a second elongated device 470 that intersects at least one of the plates 465. Like the first elongated device 420, the second elongated device 470 may be made of any flexible material such as string or a wire strip.

The second elongated device 470 has a first end 472 that is connected to the actuator 120 and a second end 474 that is designed to engage a plate 475 positioned along the first portion 165 of the moveable device 115, which is at the edge of the flexible strip 400 farthest from the body 105. In this way, when the second elongated device 470 is actuated by the actuator 120, the second elongated device 470 may be pulled toward the actuator and the second end 474 engages the plate 475. Upon engagement of the plate 475, the flexible strip 400 bends and thus the first portion 165 is rotated in a second device direction (for example, in a direction as depicted by arrow 480 in FIG. 5) about the device axis 160. The second device direction is different from the first device direction.

As shown, the plate 465 is offset from the plate 415 along the length of the flexible strip 400.

Figure 7:
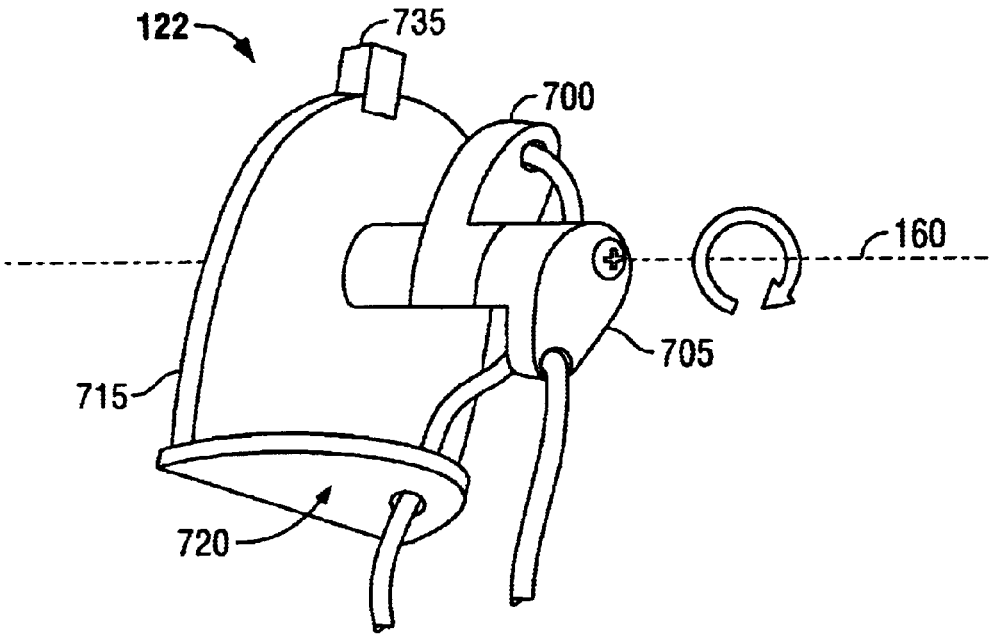
FIG. 7 is a perspective view of a portion of an actuator for actuating the moveable device of FIGS. 4–6.

Referring also to FIG. 7, the actuator 120 may be designed with first and second levers 700, 705, respectively, that are rotatable about the drive axis 150. The levers 700, 705 rotate simultaneously upon actuation. The actuator 120 includes a base plate 715 that positions the moveable device 115 relative to the levers 700, 705. The moveable device 115 may be attached to a bottom portion 720 of the base plate 715 using any suitable technique. For example, a plate 435 (FIG. 7) may be glued (or otherwise fastened) to the bottom portion 720. As another example, the base plate 715 may be formed integrally to the moveable device 115.

The base plate 715 is rotatable about the drive axis 150 such that the levers 700, 705 rotate when the base plate 715 rotates. The base plate 715 may include a projection 735 that engages projections 740, 745 attached to the body 105 to prevent the base plate 715 from rotating beyond positions that correspond to the positions of the projections 740, 745.

The base plate 715 is rotated when the levers 700, 705 are rotated to effectuate a compound movement of the appendage 110. If the toy 100 is a stuffed animal, then this compound movement resembles a hugging motion.

Figure 8:
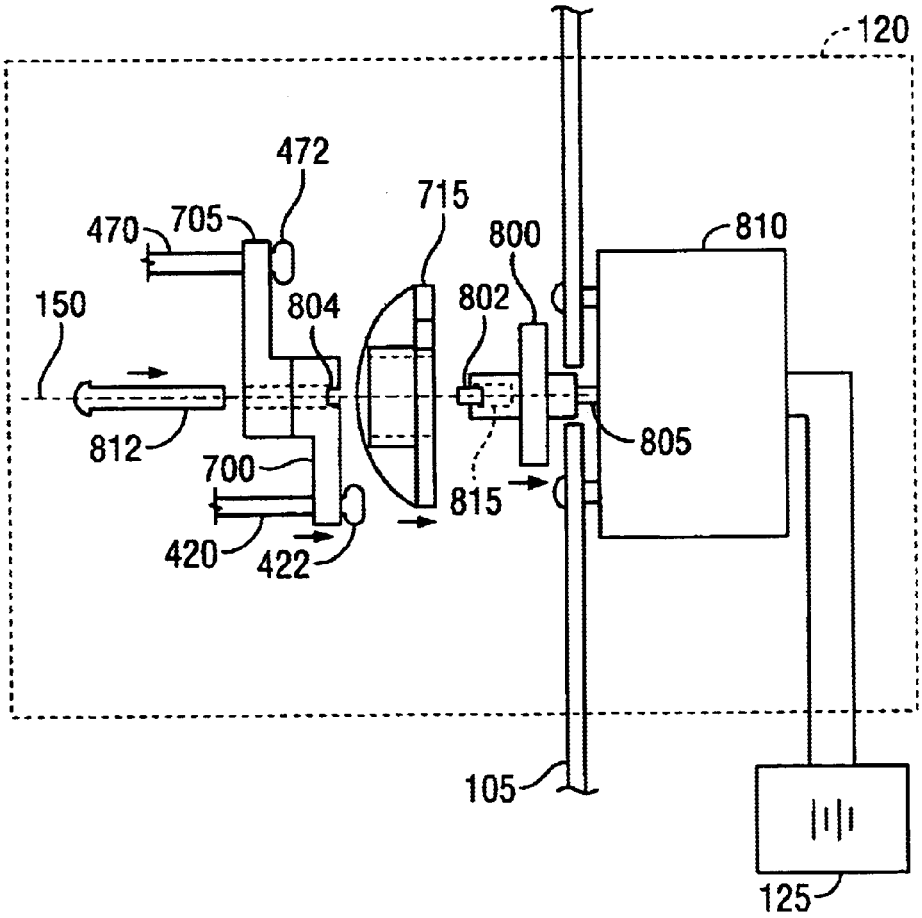
FIGS. 8 and 9 are side views of the actuator, a portion of which is shown in FIG. 7.
Figure 9:
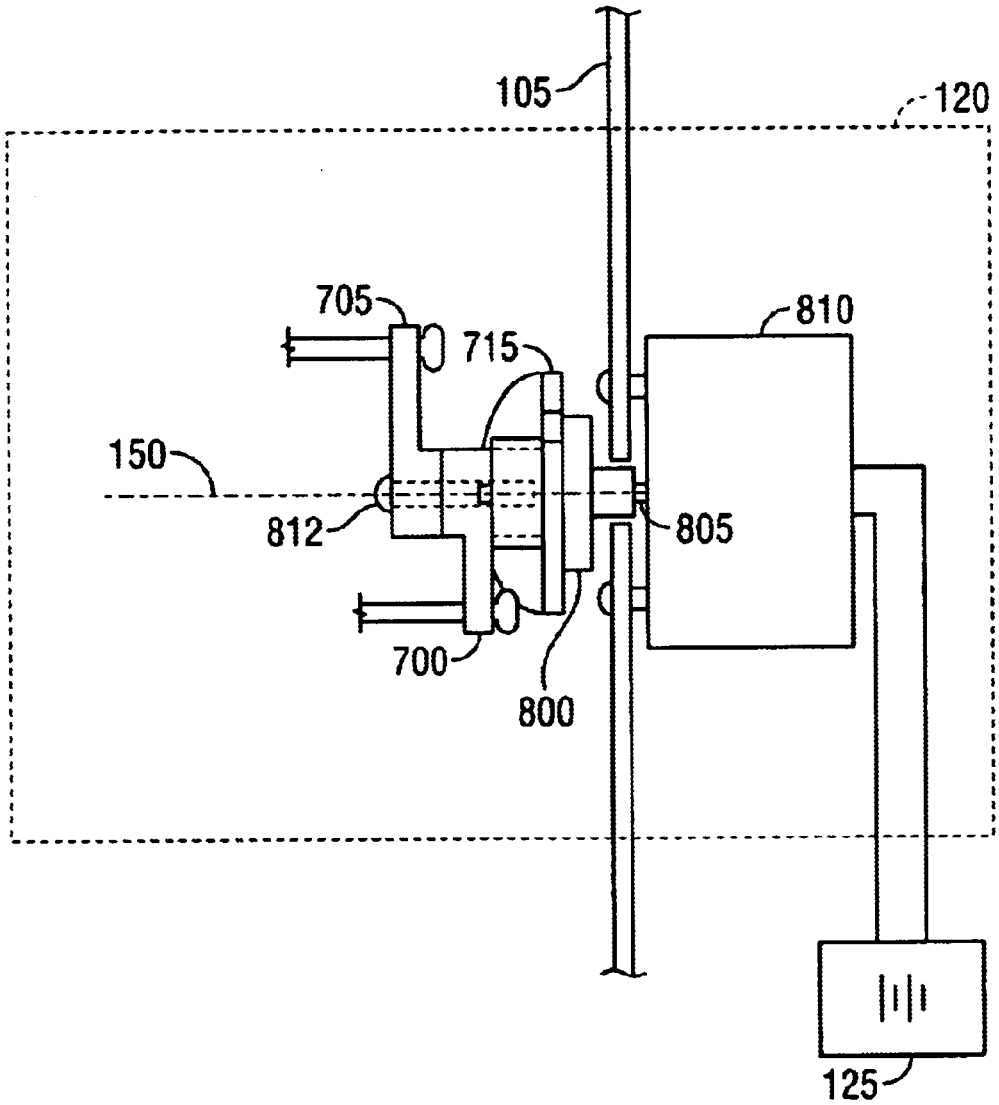
Figure 10:
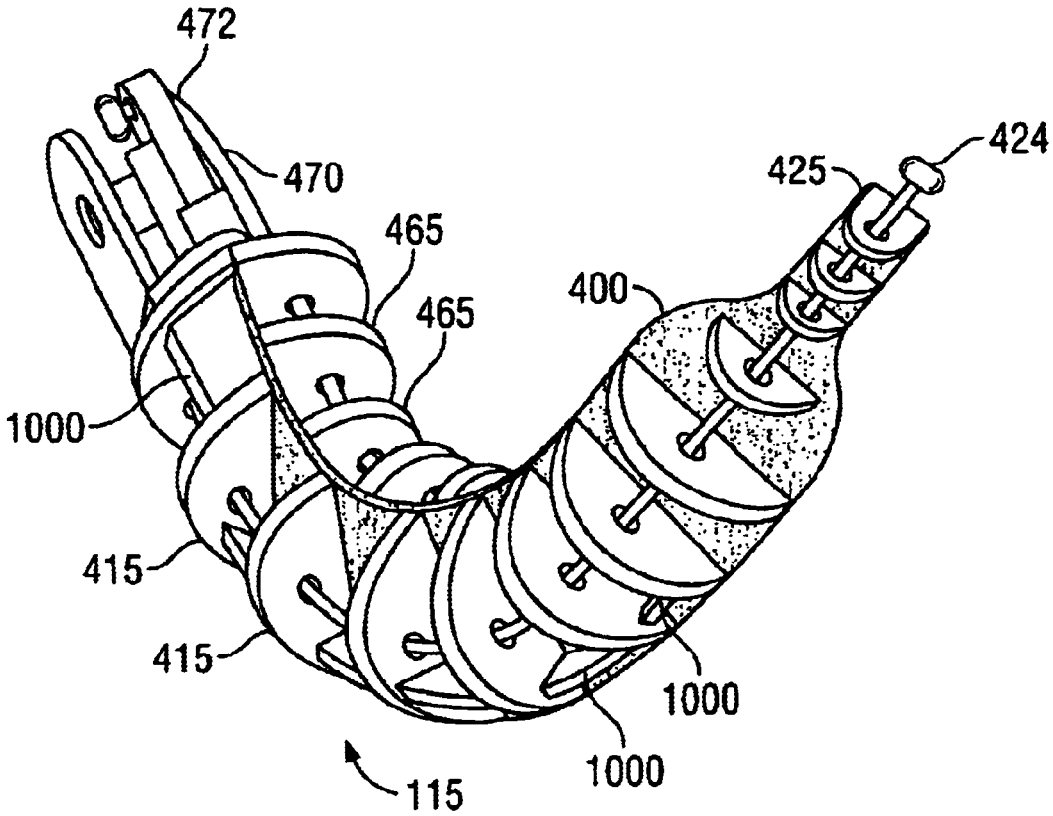

Referring to FIGS. 8 and 9, the actuator 120 also includes a rotating device 800, a rotating drive 805, and a motor 810. The rotating device 800 is attached to the rotating drive 805 and the rotating drive 805 is integral to the motor 810. Thus, when the motor 810 is powered, it rotates the rotating drive 805, which in turn rotates the rotating device 800 about the drive axis 150. The rotating device 800 has a projection 802 that engages a notch 804 in the lever 700 (as shown), lever 705 (not shown), or a structure to which levers 700 and 705 connect (not shown), to rotate the levers 700, 705 when the motor 810 turns the rotating drive 805. The levers 700, 705 and the base plate 715 are secured to the rotating device 800 with any suitable attachment technique. For example, as shown, the levers 700, 705 and the base plate 715 may be formed with holes through which a screw 812 passes and the rotating device 800 may be formed with a threaded hole 815 for receiving the screw 812.

During operation, the motor 810 rotates the moveable device 115 in the first main direction 730 simultaneously with rotation of the first portion relative to the second portion in the first device direction 430 as shown in FIG. 4. In particular, the motor 810 rotates the device 800, which rotates the base plate 715, which rotates the moveable device 115 that is attached to the base plate 715 about the drive axis 150 in the first main direction 730. At some point during rotation of the moveable device 115, the device 800 rotates the first lever 700, which pulls the first elongated device 420 and engages the plate 425, causing the first portion 165 to rotate relative to the second portion 170 about the device axis 160 in the first device direction 430.

The device 800 may begin to rotate the first lever 700 after the moveable device 115 has finished rotating, for example, after the projection 735 engages projection 740. In another implementation, the device 800 may begin to rotate the first lever 700 when it begins to rotate the moveable device 115 about the drive axis 150.

During rotation of the lever 700, the second lever 705 is rotated in a direction that reduces the tension on the second elongated device 470, thus creating a slack in the second elongated device 470.

When the motor 810 is reversed, it rotates the moveable device 115 in the second main direction 725 simultaneously with rotation of the first portion relative to the second portion in the second device direction 480 as shown in FIG. 5. In particular, the motor 810 rotates the device 800, which rotates the base plate 715, which rotates the moveable device 115 that is attached to the base plate 715 about the drive axis 150 in the second main direction 725. At some point during rotation of the moveable device 115, the device 800 rotates the second lever 705, which pulls the second elongated device 470 and engages the plate 475, causing the first portion 165 to rotate relative to the second portion 170 about the device axis 160 in the second device direction 480.

The device 800 may begin to rotate the second lever 705 after the moveable device 115 has finished rotating, for example, after the projection 735 engages projection 745. In another implementation, the device 800 may begin to rotate the second lever 705 when it begins to rotate the moveable device 115 about the drive axis 150.

During rotation of the second lever 705, the first lever 700 is rotated in a direction that reduces the tension on the first elongated device 420, thus creating a slack in the first elongated device 420.

In this way, the motor 810 may be used to impart upon the appendage 110 a compound motion defined by directions 430 and 730 or by directions 480 and 725.

Other implementations are within the scope of the following claims. For example, in another implementation, the power source 125 may be a mechanical source that includes a device that is operated by a user. For example, the mechanical source may include a string attached to the body 105 that the user pulls. As another example, the mechanical source may include a lever attached to the body 105 that the user pulls. As a further example, the mechanical source may include a dial attached to the body 105 that the user rotates.

The actuator 120 may be configured to function as described above yet implement gears and/or pulley to effectuate the compound motions.

In another implementation, if the moveable device 415 does not include plate 465, the actuator 120 may be designed with a single lever 700 for actuating the first elongated device 420 and for moving the flexible strip in the first device direction 430. If the moveable device 415 includes both plate 415 and plate 465, then the actuator 120 may be designed such that levers 700 and 705 rotate independently upon actuation.

The appendage 110 may be any extension from the body 105 of the toy 100. For example, the appendage 110 may be a leg, a hand, or an arm. As another example, the appendage may be a tail or an elongated neck. The toy 100 may be any design, including animals, humans, robots, or machines.

The plate 465 may be designed to align with the plate 415 along the length of the flexible strip 400.

The flexible strip 400 may include one or more dividing plates 1000 positioned along the first or second surfaces 405, 410 of the flexible strip 400. The dividing plates 1000 are positioned to be transverse to the plates 415 and to the flexible strip 400. In this way, the dividing plates 100 serve to strengthen the flexible strip 400 and/or prevent the flexible strip 400 from bending excessively or breaking.

To facilitate relative movement between the first portion 165 and the second portion 170, the flexible strip 400 may have a varying thickness such that a thickness of the strip 400 nearest to the body 105 is greater than a thickness of the strip 400 farthest from the body 105.

In another implementation, if the first elongated device 420 is made of the flexible yet firm material, then the first elongated device 420 may be actuated by the actuator 120 by being pulled toward the actuator 120 (as discussed) or by being pushed away from the actuator 120.

What is claimed is:

1. An apparatus for moving a toy appendage, the apparatus comprising:

a moveable device within a toy appendage that is attached to a body of a toy, the moveable device including an elongated device extending from the toy body; and an actuator including a lever mounted to a drive shaft that rotates about a drive axis, the drive axis being fixed relative to the toy body, the lever connected to the elongated device of the moveable device to rotate the moveable device about the drive axis and to rotate at least a first portion of the moveable device relative to at least a second portion of the moveable device about a device axis that is fixed relative to the moveable device as the drive shaft rotates the lever about the drive axis.

2. The apparatus of claim 1 in which the actuator comprises a motor;

wherein the drive shaft is connected to the motor and to the lever, the drive shaft defining the drive axis.

3. The apparatus of claim 1 in which the lever is coupled to the at least first portion of the moveable device.

4. The apparatus of claim 1 in which the moveable device comprises:

a flexible strip;

a plate positioned in the at least first portion of the moveable device, with the plate being transversely connected to the flexible strip; and an elongated device that intersects the plate.

5. The apparatus of claim 4 in which the lever is connected to the elongated device such that when the drive shaft rotates the lever, the lever actuates the elongated device to exert a tension on the plate, thus rotating the at least first portion of the moveable device relative to the second portion.

6. The apparatus of claim 1 in which the motor is configured to rotate the at least first portion relative to the at least second portion in a first device direction about the device axis if the drive shaft is rotated in a first main direction about the drive axis.

7. The apparatus of claim 6 in which the motor is configured to rotate the at least first portion relative to the at least second portion in a second device direction about the device axis if the drive shaft is rotated in a second main direction about the drive axis;

in which the second device direction is opposite to the first device direction and the second main direction is opposite to the second device direction.

8. The apparatus of claim 1 in which the at least first portion and the at least second portion are included in the moveable device.

9. The apparatus of claim 1 in which the drive axis is different from the device axis.

10. The apparatus of claim 1 in which the actuator is configured to:

rotate the at least first portion relative to the at least second portion in a first device direction about the device axis if the moveable device is rotated in a first main direction about the drive axis; and rotate the at least first portion relative to the at least second portion in a second device direction about the device axis if the moveable device is rotated in a second main direction about the drive axis.

11. A method of actuating an appendage attached to a body of a toy, the method comprising:

rotating a lever mounted to a drive shaft about a drive axis that is fixed relative to the body of the toy, the lever being connected to an elongated device that extends along the appendage;

in which rotation of the lever causes the appendage to rotate about the drive axis and causes at least a first portion of the appendage to rotate relative to at least a second portion of the appendage about a device axis that is fixed relative to the appendage.

12. The method of claim 11 in which rotating the lever comprises causing a drive shaft connected to a motor to rotate the lever, the drive shaft defining the drive axis.

13. The method of claim 11 in which rotating the at least first portion of the appendage relative to the at least second portion of the appendage comprises coupling the lever to the at least first portion of the appendage.

14. The method of claim 11 in which rotating the appendage about the drive axis occurs before rotating the at least first portion relative to the at least second portion.

15. The method of claim 11 in which rotating the appendage about the drive axis occurs simultaneously with rotating the at least first portion relative to the at least second portion.

16. An apparatus for a moving a toy appendage, the apparatus comprising:

a moveable device within a toy appendage that is attached to a body of a toy, the moveable device including:

a flexible strip, a plate transversely connected to the flexible strip and positioned within a first portion of the moveable device, and an elongated device that intersects the plate; and an actuator coupled to the moveable device to rotate the moveable device about a drive axis, the actuator coupled to the at least first portion of the moveable device to rotate the at least first portion of the moveable device relative to at least a second portion of the moveable device about a device axis that is fixed relative to the moveable device.

17. The apparatus of claim 16 in which the lever is connected to the elongated device such that when the lever is rotated, the lever actuates the elongated device to exert tension on the plate, thus rotating the at least first portion of the moveable device relative to the second portion.

18. An apparatus for moving an appendage of a toy, the apparatus comprising:

a moveable device within a toy appendage that is attached to a body of the toy; and an actuator including a motor having a drive shaft configured to rotate about a drive axis and being connected to the moveable device such that as the drive shaft rotates about the drive axis, the actuator causes the moveable device to rotate about an axis that is parallel with the drive axis and causes at least a first portion of the moveable device to rotate relative to at least a second portion of the moveable device about a device axis that is fixed relative to the moveable device.

19. The apparatus of claim 18 in which the actuator causes the moveable device to rotate about the drive axis.

20. The apparatus of claim 18 in which the drive axis is fixed relative to the body of the toy.

21. An apparatus for moving an appendage of a toy, the apparatus comprising:

a moveable device within a toy appendage of the toy; and an actuation system coupled to a motor and to the moveable device, the actuation system being constrained to rotate about a single drive axis such that the actuation system causes the moveable device to rotate about an axis that is parallel with the drive axis and causes at least a first portion of the moveable device to rotate relative to at least a second portion of the moveable device about a device axis that is fixed relative to the moveable device.

22. The apparatus of claim 21 in which the drive axis is different from the device axis.

23. The apparatus of claim 21 in which the drive axis is fixed relative to the body of the toy.

* * * * *